US007477756B2

(12) United States Patent
Wickstrom et al.

(10) Patent No.: US 7,477,756 B2
(45) Date of Patent: Jan. 13, 2009

(54) ISOLATING DEEP CANAL FITTING EARPHONE

(75) Inventors: Timothy K. Wickstrom, Elk Grove Village, IL (US); William J. Ballad, Buffalo Grove, IL (US); David M. Schaefer, Downers Grove, IL (US)

(73) Assignee: Knowles Electronics, LLC, Itasca, IL (US)

( * ) Notice: Subject to any disclaimer, the term of this patent is extended or adjusted under 35 U.S.C. 154(b) by 260 days.

(21) Appl. No.: 11/366,092

(22) Filed: Mar. 2, 2006

(65) Prior Publication Data

US 2007/0217642 A1 Sep. 20, 2007

(51) Int. Cl.
*H04R 25/00* (2006.01)

(52) U.S. Cl. ..... 381/380; 381/328

(58) Field of Classification Search ..... 381/328, 381/370, 374, 380, 384, 395, 324, 325; 181/129, 181/135

See application file for complete search history.

(56) References Cited

U.S. PATENT DOCUMENTS 4,133,984 A 1/1979 Akiyama
5,701,348 A * 12/1997 Shennib et al. ..... 381/328
5,917,918 A 6/1999 Callahan
6,094,494 A 7/2000 Haroldson
6,359,993 B2 * 3/2002 Brimhall ..... 381/328
6,459,800 B1 * 10/2002 Brimhall ..... 381/324
RE38,351 E 12/2003 Iseberg et al.
6,993,144 B1 1/2006 Wilson et al.
2002/0196958 A1 12/2002 Haltren et al.
2004/0215053 A1 10/2004 Jorgensen et al.
2005/0196005 A1 9/2005 Shennib et al.

OTHER PUBLICATIONS

International Search Report for International Application No. PCT/US06/07835 dated Nov. 21, 2006.

* cited by examiner

*Primary Examiner*—Brian Ensey
(74) *Attorney, Agent, or Firm*—Fitch, Even, Tabin & Flannery

(57) ABSTRACT

An insert earphone comprises a housing and at least one transducer that is located in the housing. The transducer is adapted to receive electrical energy and to responsively convert the electrical energy into acoustic energy for presentation to an eardrum of a user. The transducer is positioned within the housing so as to be in close proximity to the eardrum of the user when the housing is inserted into the ear canal. At least one sealing member is coupled to the housing. The at least one sealing member is adapted to provide an acoustic seal within the ear canal of the user.

11 Claims, 5 Drawing Sheets

ISOLATING DEEP CANAL FITTING EARPHONE

TECHNICAL FIELD

This patent relates to listening devices, and more particularly, to isolating earphones.

BACKGROUND

Transducers such as receivers and speakers are useful in many listening devices such as earphones, headphones, Bluetooth wireless headsets, or the like. For instance, a receiver may convert electrical energy received from an audio signal device into acoustic energy and subsequently present the acoustic energy to the eardrum of the user for listening.

General speaking, conventional insert earphones are designed to isolate the desired sound presented at the user's ear drum from other sounds and/or noise from the outside environment. In this regard, previous insert earphones typically include a housing having a wide, rigid sound passage tube and a receiver mounted within the housing. A rigid eartip attached around the sound passage tube may be located externally to the housing. When the sound passage tube attached to the housing is inserted into the ear canal of the user, airborne sound moves through the eartip. The eartip engages the walls of the ear canal. In these systems, the receiver within the housing is positioned near the entrance to the ear canal to receive the sound energy.

Unfortunately, several problems exist with these previous approaches. For instance, achieving an airtight or otherwise adequate seal in the ear canal is often difficult or impossible. This leads to undesirable sounds (e.g., background noise) entering the ear canal and desirable sounds (e.g., music from an attached listening device) escaping from the ear canal. In addition, these previous devices frequently cause considerable discomfort when worn by the user, due to the hardness of the tube and shape of the eartip. Custom molded earphones have also been attempted, but the manufacture and assembly of these custom molded devices is expensive and labor intensive.

BRIEF DESCRIPTION OF THE DRAWINGS

For a more complete understanding of the disclosure, reference should be made to the following detailed description and accompanying drawings wherein.

Figure 1:
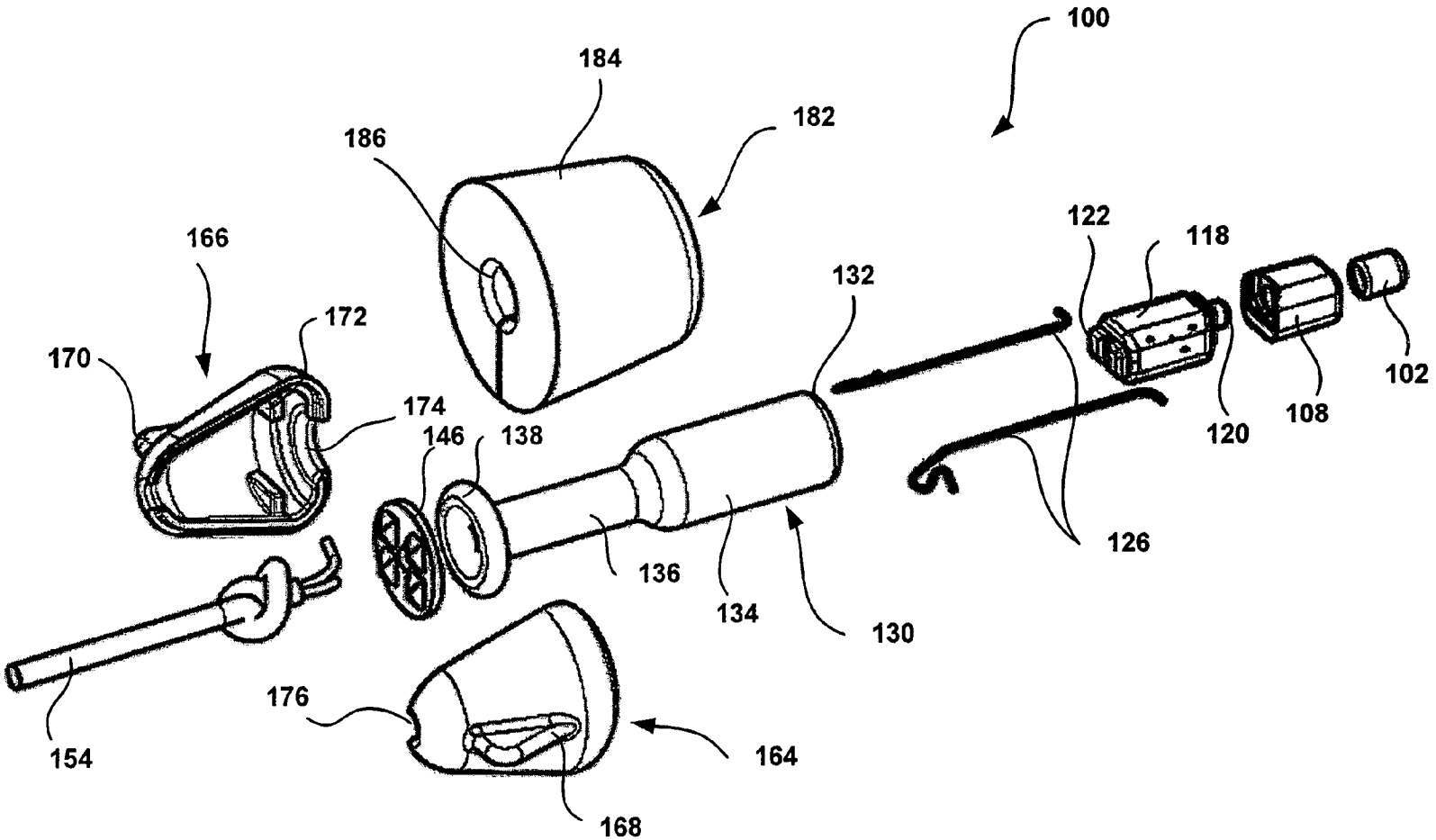
FIG. 1 is an exploded view illustrating an earphone according to the present invention.

Skilled artisans will appreciate that elements in the figures are illustrated for simplicity and clarity. It will further be appreciated that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

While the present disclosure is susceptible to various modifications and alternative forms, certain embodiments are shown by way of example in the drawings and these embodiments will be described in detail herein. It will be understood, however, that this disclosure is not intended to limit the invention to the particular forms described, but to the contrary, the invention is intended to cover all modifications, alternatives, and equivalents falling within the spirit and scope of the invention defined by the appended claims.

Isolating earphones using deep canal fittings and approaches for assembling and using these devices are provided. The approaches described herein provide one or more seals to minimize the background noise received by listening devices (e.g., transducers) that are positioned deeply within a user's ear canal. The seal or seals also prevent desirable sounds from escaping from the ear canal. These approaches reproduce sounds with audio fidelity and provide devices that are comfortable for a user to wear. In addition, the devices described herein are easy and cost effective to produce.

In many of these embodiments, an insert earphone comprises a housing and at least one transducer that is located in the housing. The transducer is adapted to receive electrical energy and to responsively convert the electrical energy into acoustic energy for presentation to an eardrum of a user. The transducer is positioned within the housing so as to be in close proximity to the eardrum of the user when the housing is inserted into the ear canal. At least one sealing member is coupled to the housing. The sealing member is adapted to provide an acoustic seal within the ear canal of the user.

The seal (or seals) provided by the at least one sealing member limit the transmission of sound into the ear canal from outside the ear canal. Consequently, outside sounds do not reach the transducer thereby eliminating or substantially reducing background noise presented to the user's ear drum. Furthermore, the seal or seals also prevent desirable sounds (i.e., those sounds desired to be presented to the ear drum of the user) from escaping from the ear canal. In addition, the earphone is comfortable to wear, provides high audio fidelity, and can be worn by the user over extended periods of time. Since the device is not custom designed or fitted for a particular user, it is cost effective and easy to produce.

The sealing member can take a number of different forms. For instance, the sealing member may be a coupling member that is coupled to an outer wall of the housing. In another example, the sealing member is a handle positioned at an end of the housing. In still another example, the sealing member is both a coupling member and a handle. In addition, other structural forms may be used as the sealing member or members.

If a coupling member is used, the coupling member may be formed from a number of soft compliant materials such as polyurethane foam, polymers, and silicones. In addition, the transducer may be a single device or multiple devices. For instance, the transducer may be a receiver, conjoined receiver and microphone, or a dual receiver.

As mentioned, the insert earphone is inserted into the ear canal of a user in close proximity to the eardrum of the user. If a coupling member is used, the coupling member may be supported substantially entirely or entirely by the ear canal of the user and provide a seal in the ear canal.

In others of these embodiments, approaches are provided to insert an earphone into the ear canal of a user. For instance, in one example, at least one transducer is inserted into the ear canal of a user. The transducer is positioned within the ear canal so as to be in close proximity to an eardrum of the user and converts electrical energy into acoustic energy for presentation to the ear drum of the user. At least one acoustic sealing member is positioned outward from the transducer so as to provide an acoustic seal that substantially prevents noise originating outside of the ear canal from entering the ear canal of the user. In addition, desirable noise is retained in the ear canal.

Turning now to the drawings and referring now to FIG. 1, an exploded view of an exemplary earphone 100 is described. The earphone 100 includes a damper plug 102, a bushing member 108, at least one transducer 118, a pair of wire 126, a housing 130, a circuit assembly 146, a cable 154, a handle 162 (see FIG. 2), and a coupling member 182.

The transducer 118 may be a single device or multiple devices. For example, the transducer 118 may be a receiver, a conjoined receiver and microphone, or a dual receiver. The transducer 118 comprises a sound outlet tube 120 and an electrical input terminal 122 and is operative for generating an acoustic output signal at the sound outlet tube 120 as a function of an electrical signal applied to the input terminal 122.

The circuit assembly 146 may process the electrical signals received. The damper plug 102 is attached to the sound outlet tube 120 of the receiver 118 and the input terminal 122 of the receiver 118 is electrically coupled through the wire 126 to the cable 154. Once the receiver 118 is held in contact with the bushing member 108, the damper plug 102, and the wire 126, the receiver 118 is positioned within the housing 130.

The housing 130 includes an opening 132, a body portion 134, a tubular portion 136, and an annular member 138. The annular member 138 of the housing 130 is sized to receive the circuit assembly 146. One end of the wire 126 is electrically coupled to the cable 154 via the circuit assembly 146. The handle 162 is formed of two handle components 164 and 166 that snap fit against the housing 130. However, it will be understood that the components 164 and 166 may be joined together by mechanical fastening, crimping or any other suitable attachment arrangement. The coupling member 182 mates with the housing 130.

Figure 2:
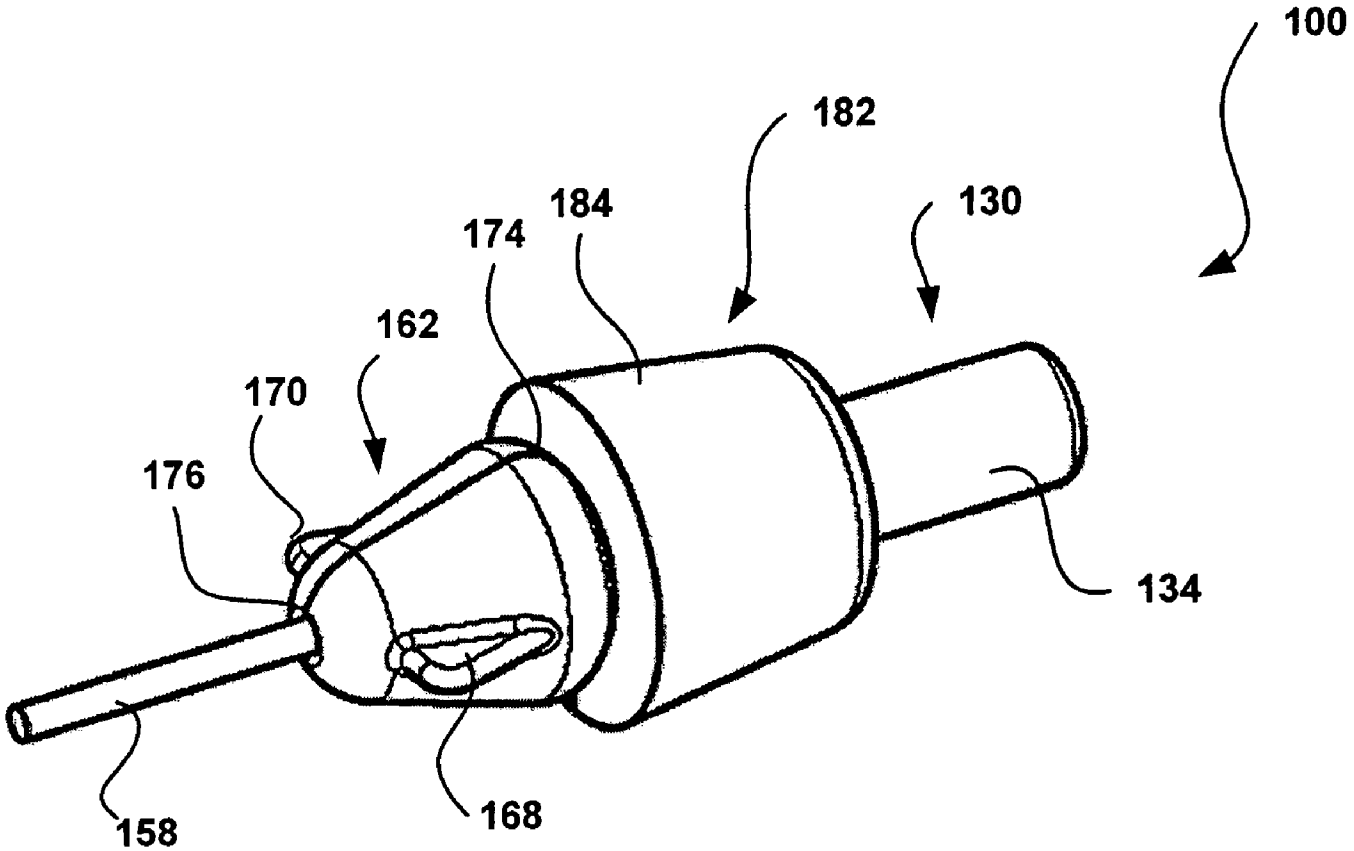
FIG. 2 is a perspective view of the earphone of FIG. 1 according to the present invention.

FIG. 2 illustrates a perspective view of the earphone 100. The housing 130 is flexible and may be molded from plastic in one piece and serves the functions of retaining the receiver 118 mounted to the bushing member 108 and the wire 126 (see FIG. 1), supporting the circuit assembly 146 for connection to the cable 154, and supporting the coupling member 182. The coupling member 182 is arranged to conform to the shape of the walls of the ear canal of the user in order to provide an acoustic seal in the ear canal. The coupling member 182 also provides the main support or the entire support for the earphone 100 within the ear canal. The coupling member 182 comprises a soft compliant material such as polyurethane foam, polymer, silicone or a similar material and may be molded from the above-mentioned material in one piece. The coupling member 182 is disposable after use thereby eliminating the accumulation of ear wax or debris on the coupling member 182.

The handle 162 includes at least two holders 168 and 170 to provide for removal and replacement of the internal components (e.g., the circuit assembly 146 or capacitors (not shown)). The handle 162 is pressed or molded into a shape having a hollow section (not shown) to accommodate the internal components (not shown). The handle 162 is preferably located at the annular member 138 of the housing 132. In some of these embodiments, the handle 162 can provide a second seal in addition to the seal provided by the coupling member 182. Alternatively, the coupling member 182 may be omitted and a single seal provided by the handle 162.

The handle 162 can be manufactured in a variety of configurations with any desired geometry. More specifically, the handle 162 includes a first opening 174 that mates with the tubular portion 136 of the housing 130 such that the annular member 138 of the housing 130 is securely retained within the handle 162 by a flange (not shown) and a second opening 176 to receive the cable 154. The handle 162 comprises a rigid and durable material such as polypropylene (pp) or a similar material (e.g., a polymer) and may be molded in one piece or more pieces.

Figure 3:
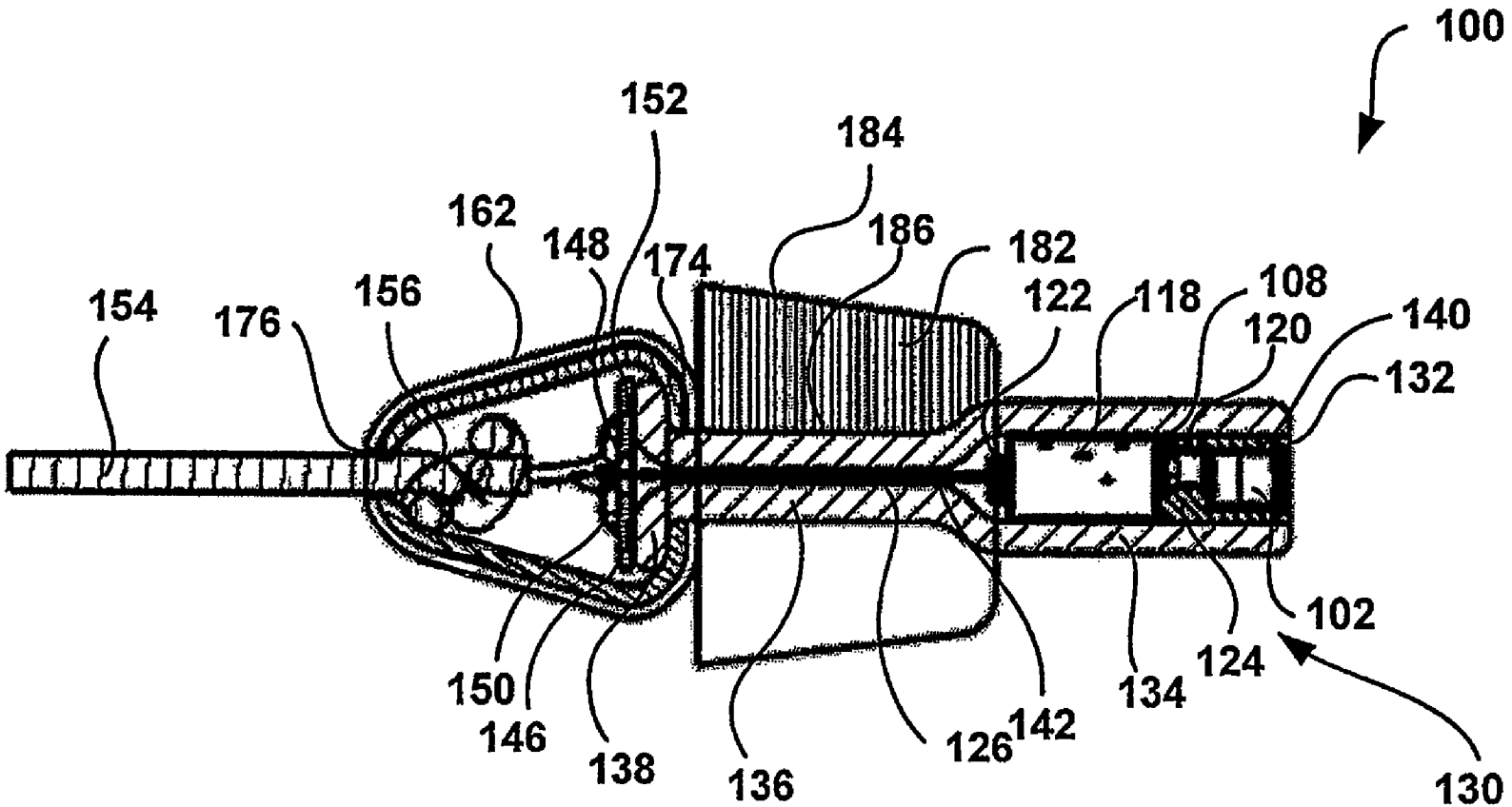
FIG. 3 is a cross-sectional view of the earphone shown in FIG. 1 according to the present invention.

FIG. 3 illustrates a cross-sectional view of the exemplary earphone 100 in conjunction with an exemplary method of assembling the earphone 100. As discussed earlier, the receiver 118 is mounted against the bushing member 108 and a filler 124 such as cement or a similar material is applied to fill the gap of the hollow section of the bushing member 108 and around the sound outlet tube 120 of the receiver 118. In one example, the bushing member 108 is pressed or molded from plastic in one piece. The damper plug 102 in the form of a tube shape may be made of stainless steel and is oriented according to the side wall of the bushing member 108, until the sound outlet tube 120 of the receiver 118 butts up against the side wall of the damper plug 102 to allow the acoustic signal travel to the ear canal.

A dust guard or acoustic resistor may be made of cloth or felt is attached within the damper plug 102 by any suitable method of attachment provides an acoustical resistance to the receiver 118 and prevents debris or ear wax from entering the receiver, which may damage the working components contained within the receiver 118. The damper plug 102 is preferably disposable and replaceable when clogged with ear wax or otherwise defective. The receiver 118 that is mounted to the bushing member 108 is retained in a first chamber 140 of the housing 130.

One end of the wire 126 is electrically coupled to the input terminal 122 of the receiver 118 and the other end of the wire 126 is electrically coupled to the connections 150 of the circuit assembly 146. A slack of wire (not shown) may be provided to prevent tension in the wire. As shown, the wire 126 is retained in a second chamber 142 of the housing 130 wherein the second chamber 142 is formed in the tubular portion 136 of the housing 130. The dimensions of the second chamber 142 are preferably smaller than or equal to the dimensions of the first chamber 140. The circuit assembly 146 includes a circuit board 152, a hole 148, and a plurality of connections 150. Optional components (not shown) such as capacitors may be mounted to the circuit board 152 serve to reduce RF interference.

The circuit board 152 may be formed in various shapes and sizes corresponding to the annular member 138 of the housing 130 or otherwise according to the requirements of specific applications. The front surface of the circuit board 152 may have printed wiring traces.

As mentioned earlier, the second end of the wire 126 is mounted to the front surface of the circuit board 152 via the hole 148. The cable 154 is electrically coupled to the front surface of the circuit board 152 to provide connection to the receiver 118 via the wire 126.

Electrical signals representative of sound are transmitted by cable 154, a wire 158, circuit assembly 146, and the wire 126 to the receiver 118 from an audio signal device (not shown). The audio signal devices may be cellular phones, MP3 players or any other type of device that provides audio signals in electrical form. A strain relief (not shown) is affixed to the cable 154 with glue or any other suitable means for anchoring the cable 154 within the handle 162.

In the embodiment shown, a cable knot 156 is provided to anchor the cable 154 within the handle 162. The front surface of the circuit assembly 146 is held in contact with a plurality of flanges 172 formed within the inner surface of the handle 162 by any suitable from of attachments.

As shown in FIG. 3, the hole 148 is aligned with the second chamber 142 of the housing 130. When all the components are placed in final or closed position, the first and second handles 164, 166 are snap fit against the housing 130 and the cable 154. More specifically, the opening 174 of the handle 162 engages the annular member 138 of the housing 130 and the second opening 176 of the handle 162 engages the strain relief 156 of the cable 154. The coupling member 182 is provided on the outer portion of the housing 130. More specifically, an inner portion 186 of the coupling member 182 is affixed to the outer portion of the tubular portion 136 or the body portion 134 or both the body and tubular portions 134, 136 with glue or any other suitable means. An outer portion 184 of the coupling member 182 is positioned to come into contact with the walls of the ear canal of the user.

Figure 4:
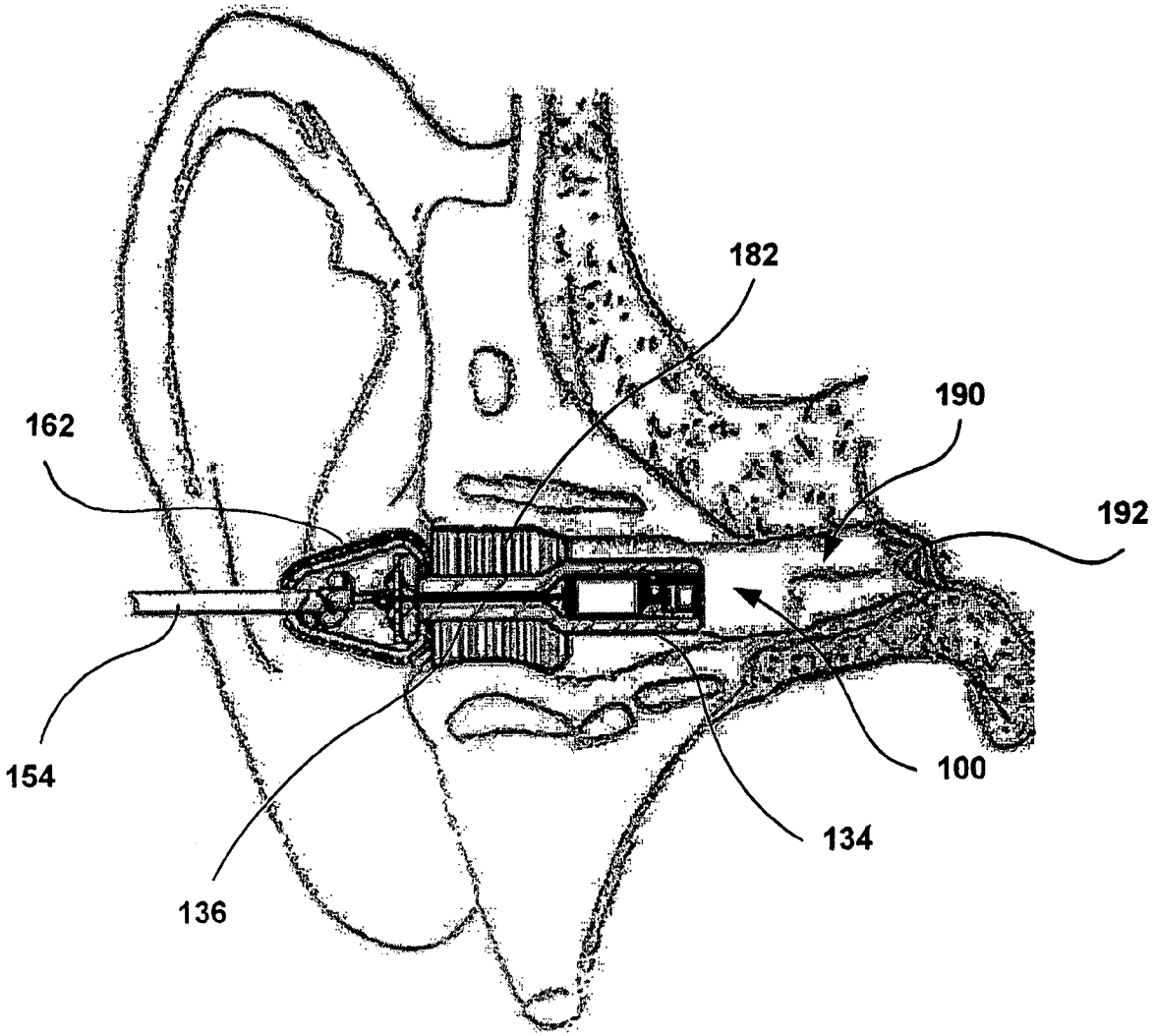
FIGS. 4 and 5 illustrate full insertion of the earphone of FIGS. 1-3 into the ear canal of a user according to the present invention.
Figure 5:
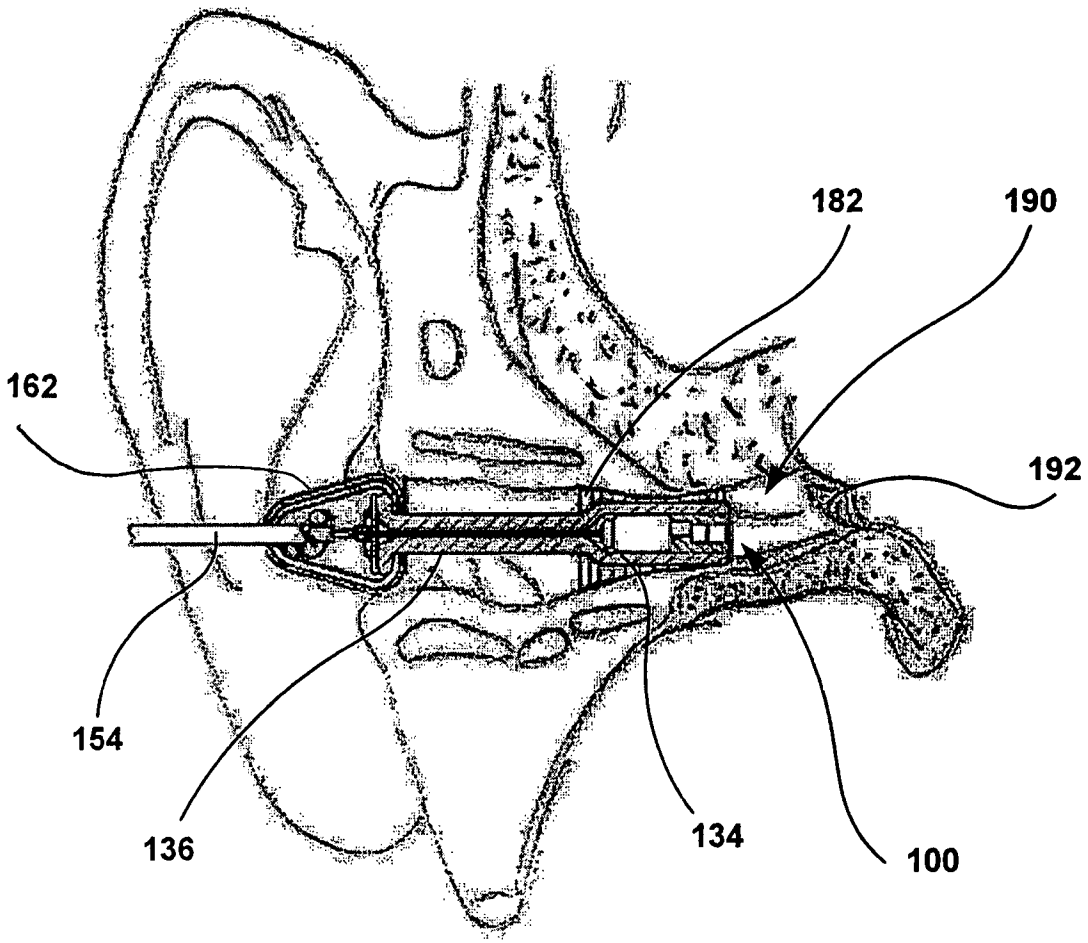

FIGS. 4-5 illustrate examples of full insertion of the exemplary earphone 100 into an ear canal 190 of a user. The earphone 100 (connected to the cable 154) is fully inserted into the ear canal 190 of a user, in close proximity to the user's eardrum 192, such that the coupling member 182 conforms to the inner walls of the ear canal 190. The coupling member 182 is supported entirely or substantially entirely by the ear canal 190 to provide a seal limiting transmission of sound to the ear canal 190. The earphone 100 (including the coupling member 182) is inserted and positioned in the ear canal 190 such that the eardrum 192 can easily receive acoustic energy from the earphone 100.

In FIG. 4, the coupling member 182 is coupled to the tubular portion 136. The earphone 100 provides a comfortable fit in the user's ear canal 190 and yet provides a good seal to reduce or eliminate noise from outside the ear from reaching the ear canal 190 and/or the transducer within the earphone 100. In addition, desirable sounds are prevented from escaping from the ear canal 190. The seal that is formed may be airtight or substantially airtight.

In an alternate embodiment shown in FIG. 5, the coupling member 182 conforms to the inner wall of the ear canal 190 and is affixed to the outer portion of the body portion 134. The coupling member 182 provides an airtight seal or substantially airtight seal in the ear canal 190. The seal limits the transmission of sound into the ear canal from outside the ear canal 190. In this example, a second seal is provided by the handle 164 as the handle fits snuggly against the end of the ear canal 190. Consequently, the outside sounds do not reach the transducer thereby eliminating or substantially eliminating background noise. Furthermore, desirable sounds are prevented from escaping from the ear canal 190. In addition, the earphone 100 is comfortable to wear, provides high audio fidelity, and can be worn by the user over extended periods of time.

The examples of FIGS. 4 and 5 show the coupling member 182 either coupled to the tubular portion 136 or the body portion 134. However, it will be understood that the coupling member 182 may be coupled to both portions 134 and 136. Furthermore, the coupling member 182 may take any form, and, for example, may be comprised of multiple portions or segments. Moreover, while some of the above-mentioned examples may use both a coupling member and a handle to provide a seal, one of these components may be omitted.

In addition, while the earphone 100 is positioned in close proximity to the eardrum 192 (such that the eardrum 192 can easily receive acoustic energy from the earphone 100), the exact dimensions of the ear canal 190 and ear drum 192 of a particular user may affect the exact positioning of the earphone 100, the coupling member 182, and the seal (or seals) formed by the coupling member 182 (and any handle or other sealing component).

Preferred embodiments of this invention are described herein, including the best mode known to the inventors for carrying out the invention. It should be understood that the illustrated embodiments are exemplary only, and should not be taken as limiting the scope of the invention.

What is claimed is:

1. An earphone assembly comprising:

a damper plug;

a bushing member adjacent to and in connection with the damper plug;

a transducer adjacent to and in direct engagement with the bushing member; and wherein the damper plug is configured to provide an acoustic resistance for the earphone assembly.

2. The earphone assembly of claim 1 wherein the damper plug is configured to be replaceable by a user.

3. The earphone assembly of claim 1 wherein the damper plug, bushing member, and transducer are disposed within the housing, and the housing is configured to being disposed within the ear canal of a user.

4. The earphone assembly of claim 3 further comprising at least one sealing member coupled to the housing, the at least one sealing member adapted to provide an acoustic seal within the ear canal of the user.

5. The earphone assembly of claim 1 wherein the transducer is an element selected from a group consisting of: a receiver, a speaker, a conjoined receiver and microphone, and a dual receiver.

6. The earphone assembly of claim 1 wherein the transducer includes an input terminal for receiving an electrical signal and wherein the transducer is operable to generate an acoustic output signal as a function of the electrical signal.

7. The earphone assembly of claim 1 wherein the transducer includes a sound outlet tube and the damper plug is configured to be attached to the sound outlet tube.

8. A subassembly for an earphone comprising:

a damper plug;

a bushing member in connection with the damper plug;

a transducer in direct engagement with the bushing member;

wherein the damper plug is configured to provide an acoustic resistance for the earphone; and wherein the transducer generates an acoustic signal and the bushing member and damper plug define a path and an acoustic impedance for the acoustic signal, the acoustic impedance being selectively modifiable according to the acoustic resistance of the damper plug.

9. The subassembly of claim 8 wherein the damper plug is configured to be replaceable by a user.

10. The subassembly of claim 8 wherein the transducer is an element selected from a group consisting of: a receiver, a speaker, a conjoined receiver and microphone, and a dual receiver.

11. The subassembly of claim 8 wherein the transducer includes an input terminal for receiving an electrical signal and wherein the transducer is operable to generate an acoustic output signal as a function of the electrical signal.

* * * * *